US007830232B2

(12) United States Patent
Grahor et al.

(10) Patent No.: US 7,830,232 B2
(45) Date of Patent: Nov. 9, 2010

(54) ARC RUNNER ASSEMBLY AND ELECTRICAL SWITCHING APPARATUS AND METHOD INCORPORATING SAME

(75) Inventors: Louis F. Grahor, Allison Park, PA (US); Roger W. Helms, Beaver Falls, PA (US); Kimberley I. Morris, Moon Township, PA (US); William M. Randal, Baldwin Township, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 12/349,072

(22) Filed: Jan. 6, 2009

(65) Prior Publication Data

US 2010/0170875 A1 Jul. 8, 2010

(51) Int. Cl.
*H01H 9/30* (2006.01)
*H01H 33/20* (2006.01)

(52) U.S. Cl. ..... 335/201; 218/148

(58) Field of Classification Search ..... 335/6, 335/201; 218/22–40, 146–151
See application file for complete search history.

(56) References Cited

U.S. PATENT DOCUMENTS 4,229,630 A 10/1980 Wafer et al.
4,278,859 A * 7/1981 Borona ..... 218/150
4,513,267 A * 4/1985 McClellan et al. ..... 335/16
4,521,655 A * 6/1985 Okado et al. ..... 218/40
4,546,336 A 10/1985 Petrie et al.
4,973,927 A * 11/1990 Carothers et al. ..... 335/10
5,818,003 A 10/1998 Moldovan et al.
5,969,314 A 10/1999 Rakus et al.
6,297,465 B1 10/2001 Groves et al.
6,417,474 B1 7/2002 Rakus et al.
6,452,470 B1 9/2002 Malingowski et al.
6,703,576 B1 3/2004 Chou et al.
2005/0279734 A1 12/2005 Carothers et al.

* cited by examiner

*Primary Examiner*—Ramon M Barrera
(74) *Attorney, Agent, or Firm*—Martin J. Moran

(57) ABSTRACT

A circuit breaker includes a conductor, a fixed contact connected to the conductor, and an arc runner disposed on the conductor adjacent the fixed contact. The arc runner includes a first portion abutting the fixed contact and a second portion disposed in a recess of the circuit breaker housing. The arc runner is adapted to draw an arc from the fixed contact. A circuit breaker operating mechanism cooperates with a movable contact for opening and closing the fixed contact and the movable contact. An arc chute is adjacent the arc runner. A trip unit cooperates with the operating mechanism to trip open the fixed and movable contacts.

4 Claims, 6 Drawing Sheets

ARC RUNNER ASSEMBLY AND ELECTRICAL SWITCHING APPARATUS AND METHOD INCORPORATING SAME

BACKGROUND

1. Field

The disclosed concept pertains generally to electrical switching apparatus and, more particularly, to such electrical switching apparatus including an arc runner. The disclosed concept also pertains to arc runner assemblies including an arc runner. The disclosed concept further pertains to methods of manufacturing electrical switching apparatus including an arc runner.

2. Background Information

Electrical switching apparatus for power distribution systems include devices such as, for instance, circuit breakers, network protectors, transfer switches and disconnect switches. Circuit breakers, for example, typically include a number of stationary electrical contacts and a number of moveable electrical contacts. The stationary and moveable contacts are in physical contact with one another when it is desired that the circuit breaker provide current therethrough to a load. When it is desired to interrupt the circuit, however, the moveable contacts are moved away from the stationary contacts, thus removing the moveable contacts from physical contact with the stationary contacts and creating a space therebetween.

The movement of the moveable contacts away from the stationary contacts results in the formation of an electrical arc in the space between the contacts beginning at the time the contacts are initially separated. Such an arc is undesirable for a number of reasons. For example, current flows through the circuit breaker to the load when it is desired that no such current should flow thereto. Additionally, the electrical arc extending between the contacts often results in vaporization or sublimation of the contact material itself, eventually resulting in destruction or pitting of the moveable and stationary contacts. It is thus desired to eliminate any such arcs as soon as possible upon their propagation.

The moveable contacts typically are mounted on arms that are contained in a pivoting assembly which pivots the moveable contacts away from the stationary contacts. An arc chute can be provided along the path of each arm to break up and dissipate such arcs. Such arc chutes typically include a plurality of spaced apart arc plates mounted in a wrapper. As the moveable contact is moved away from the stationary contact, the moveable contact moves past the ends of the arc plates, with the arc being magnetically urged toward and between the arc plates. The arc plates are electrically insulated from one another such that the arc is broken up and extinguished by the arc plates. Examples of arc chutes are disclosed in U.S. Pat. Nos. 6,703,576; 6,297,465; 5,818,003; and 4,546,336.

It is known to employ an arc runner to drive an arc from a stationary contact to an arc chamber. See, for example, U.S. Pat. Nos. 4,229,630; 5,969,314; 6,417,474; and 6,452,470.

FIG. 1 shows an example of a known arc runner assembly in which a stationary contact 2 and an adjacent arc runner 4 are disposed on a line terminal conductor 6 of a circuit breaker (not shown). The arc runner 4 is secured to the line terminal conductor 6 by a screw 8. Whenever the circuit breaker moveable contact (not shown) separates from the stationary contact 2, the resulting arc (not shown) may stall on the screw slot 10 and, thus, may not be promptly transferred to adjacent arc plates (not shown). Furthermore, this may result in the arc runner 4 blowing off of the line terminal conductor 6.

U.S. Patent App. Pub No. 2005/0279734 A1 discloses an arc runner that is fixedly retained to a conductor without the use of separate fastening hardware. Instead, the arc runner uses flexible legs that are bent or crimped in an installation step in order to secure the arc runner to the conductor. Although such design eliminates the need for separate fastening hardware, the design adds unwanted complexity to the design of the arc runner. Additionally, such design requires at least one additional step during installation of the arc runner.

There is a need, therefore, for electrical switching apparatus with an improved arrangement for extinguishing arcs generated during current interruption.

There is a more specific need for such an improved arrangement for directing the arc from a stationary contact into an arc chute.

Accordingly, there is room for improvement in electrical switching apparatus including arc runners.

SUMMARY

According to an embodiment of the disclosed concept, an arc runner assembly is for an electrical switching apparatus including a housing. The arc runner assembly comprises a conductor, a fixed contact electrically coupled to the conductor and an arc runner disposed on the conductor adjacent the fixed contact. The arc runner includes a first portion abutting the fixed contact and a second portion structured to engage a portion of the housing. The arc runner is structured to draw an arc from the fixed contact.

The arc runner may comprise a first face and an opposite second face, wherein a portion of the first face abuts the fixed contact and wherein a portion of the opposite second face is structured to engage the portion of the housing.

The fixed contact may include a first surface and the arc runner may include a second surface wherein the first surface is proximate to, and substantially coextensive with respect to the second surface.

The conductor may comprise a protruding portion and the arc runner may comprise an internal surface and an external surface, the internal surface forming a conduit and generally surrounding the protruding portion of the conductor. The conduit may be of generally rectangular shape. The external surface may be of generally rectangular shape.

According to another embodiment of the disclosed concept, an electrical switching apparatus comprises a housing, a conductor, a fixed contact electrically coupled to the conductor, an arc runner disposed on the conductor adjacent the fixed contact, a movable contact, an operating mechanism cooperating with the movable contact for opening and closing the fixed and movable contacts, and an arc chute adjacent the arc runner. The arc runner includes a first portion abutting the fixed contact and a second portion engaging a portion of the housing. The arc runner is structured to draw an arc from the fixed contact, the arc being formed from the opening of the fixed and movable contacts.

The housing may comprise a base having a recess and the arc runner may comprise a first face and an opposite second face, with a portion of the first face of the arc runner abutting the fixed contact and a portion of the opposite second face of the arc runner engaging the portion of the housing at the recess.

The fixed contact may include a first surface and the arc runner may include a second surface. The first surface being proximate to, and substantially coextensive with respect to the second surface.

The conductor may comprise a protruding portion and the arc runner may comprise an internal and an external surface.

The internal surface forming a conduit and generally surrounding the protruding portion of the conductor. The conduit may be of generally rectangular shape. The external surface may be of generally rectangular shape.

According to a further embodiment of the disclosed concept, a method of manufacturing an electrical switching apparatus comprises forming an arc runner assembly by slidably positioning a generally tubular arc runner onto an electrical conductor adjacent a fixed contact, providing a housing including a recess, and disposing at least a portion of the tubular arc runner within the recess and engaging a portion of the housing at the recess.

The method may further comprise including a base within the housing and forming the recess in the base.

The arc runner may comprise a first face and an opposite second face. The method may further comprise abutting the fixed contact with a portion of the first face of the arc runner and engaging a portion of the opposite second face of the arc runner with the portion of the housing at the recess.

The method may further comprise providing a protruding portion on the conductor and providing an internal surface and an external surface on the arc runner, wherein the internal surface forms a conduit and generally surrounds the protruding portion of the conductor.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

As employed herein, the term "fastener" shall expressly include, but not be limited to, any suitable fastening member (s) (e.g., without limitation, a threaded fastener; a non-threaded fastener; a removable fastener; a non-removable fastener; a bolt; a machine screw; a rivet; a soldered connection; an adhesive connection), which is employed such that two or more parts are connected or coupled together.

The disclosed concept is applicable to a wide variety of electrical switching apparatus such as, for example and without limitation, circuit breakers, network protectors, transfer switches and disconnect switches having separable contacts, and will be described as applied to a circuit breaker having separable contacts.

An example of a circuit breaker is disclosed in U.S. Pat. No. 6,452,470, which is incorporated by reference herein.

Figure 1:
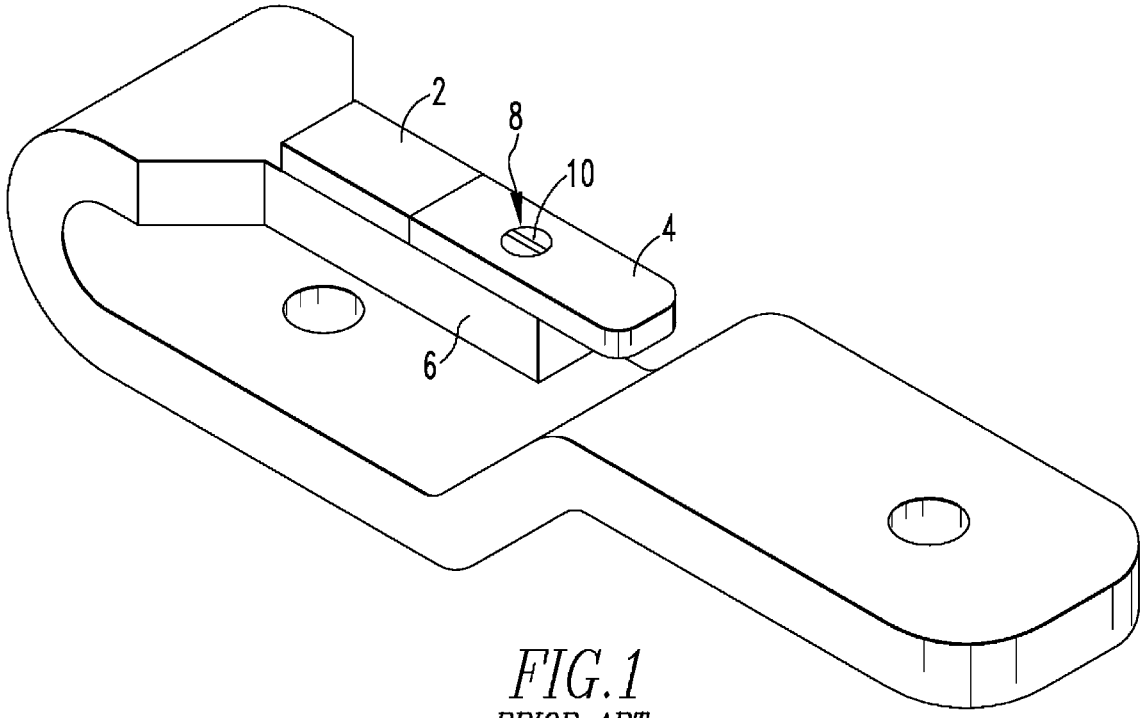
FIG.1 PRIOR ART
FIG. 1 is an isometric view of a stationary contact and arc runner assembly of a circuit breaker.
Figure 2:
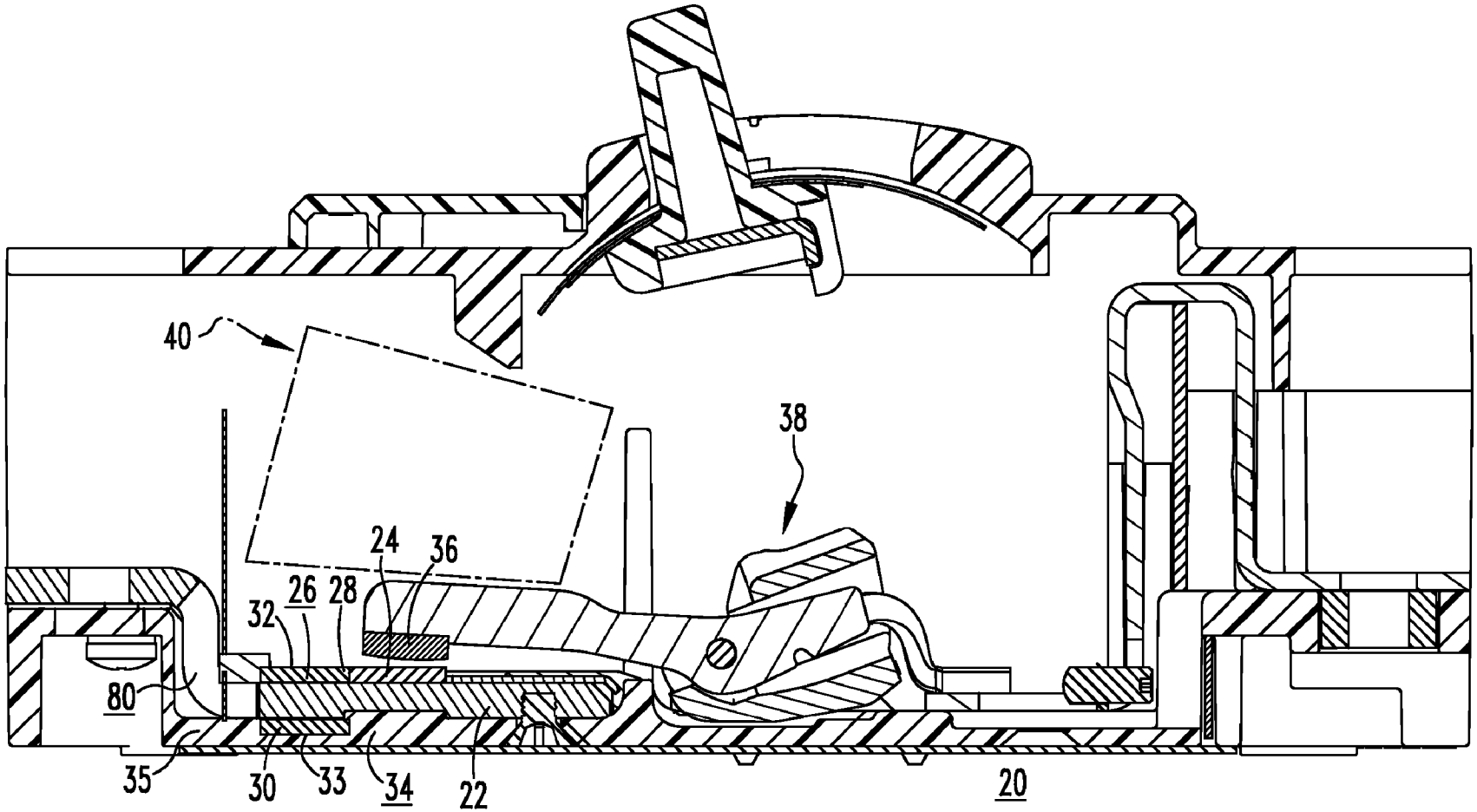
FIG. 2 is a simplified vertical sectional view of a circuit breaker including an arc runner in accordance with embodiments of the disclosed concept.

Referring to FIG. 2, an electrical switching apparatus, such as circuit breaker 20, is shown. Circuit breaker 20 includes a line terminal conductor 22, a fixed contact 24 electrically connected (e.g., without limitation, welded) to the conductor 22, and an arc runner 26 disposed on the conductor 22 adjacent the fixed contact 24. The arc runner 26 includes a first portion 28 engaging or abutting the fixed contact 24, a second portion 30 that engages a portion of the housing 34, and an intermediate portion 32 that is structured to draw an arc from the fixed contact 24. More particularly, second portion 30 engages a recess 33 formed in a base portion 35 of the housing 34 in a manner such that the engagement acts to retain the arc runner 26 on the conductor 22 as will be discussed in further detail.

As is conventional, the circuit breaker 20 includes a movable contact 36, an operating mechanism 38 cooperating with the movable contact 36 for opening and closing the fixed and movable contacts 24,36, and an arc chute 40 (shown in simplified phantom line) adjacent the arc runner intermediate portion 32.

Figure 3:
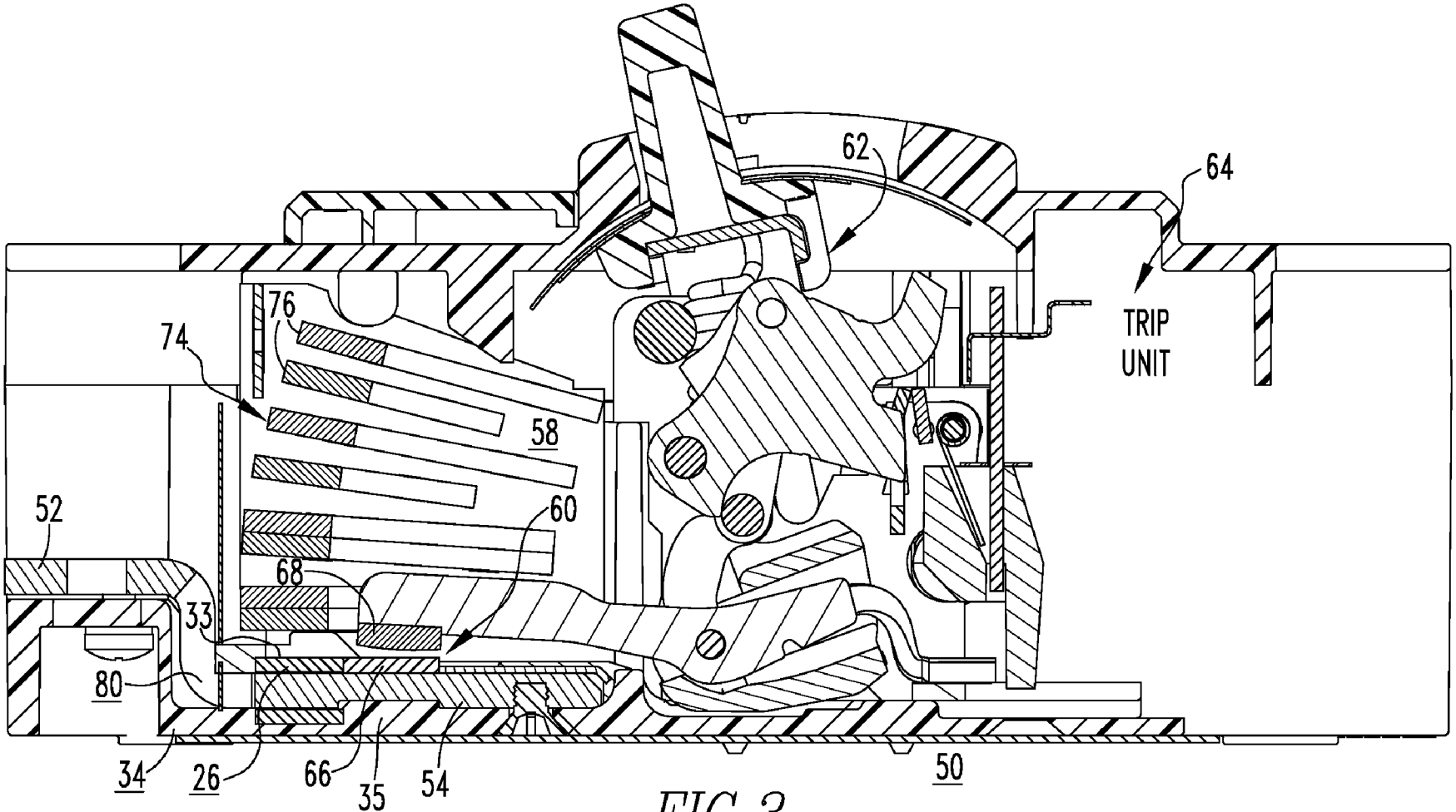
FIG. 3 is a vertical sectional view of another circuit breaker including the arc runner of FIG. 2.

FIG. 3 shows another circuit breaker 50 including the arc runner 26 of FIG. 2. The circuit breaker 50 includes a load terminal (not shown), a line terminal 52 and a line terminal conductor 54. There is shown an arc extinguisher assembly 58, a contact assembly 60, an operating mechanism 62, and a trip mechanism (trip unit) 64. The trip mechanism 64 cooperates with the operating mechanism 62 to trip open the contact assembly 60 including a fixed contact 66 and a movable contact 68. Although not shown in FIG. 3, each phase of three-phase circuit breaker 50 has its own load terminal, line terminal 52, arc extinguisher assembly 58 and contact assembly 60.

The arc extinguisher assembly 58 includes an arc chute 74 within which are positioned spaced-apart generally parallel angularly offset arc chute plates 76. The arc extinguisher assembly 58 receives and dissipates electrical arcs that are created upon separation of the contacts 66,68 of the circuit breaker 50.

As shown in FIG. 3, the arc runner longitudinal segment 33 is disposed away from the fixed contact 66 below the arc chute 74.

Figure 4:
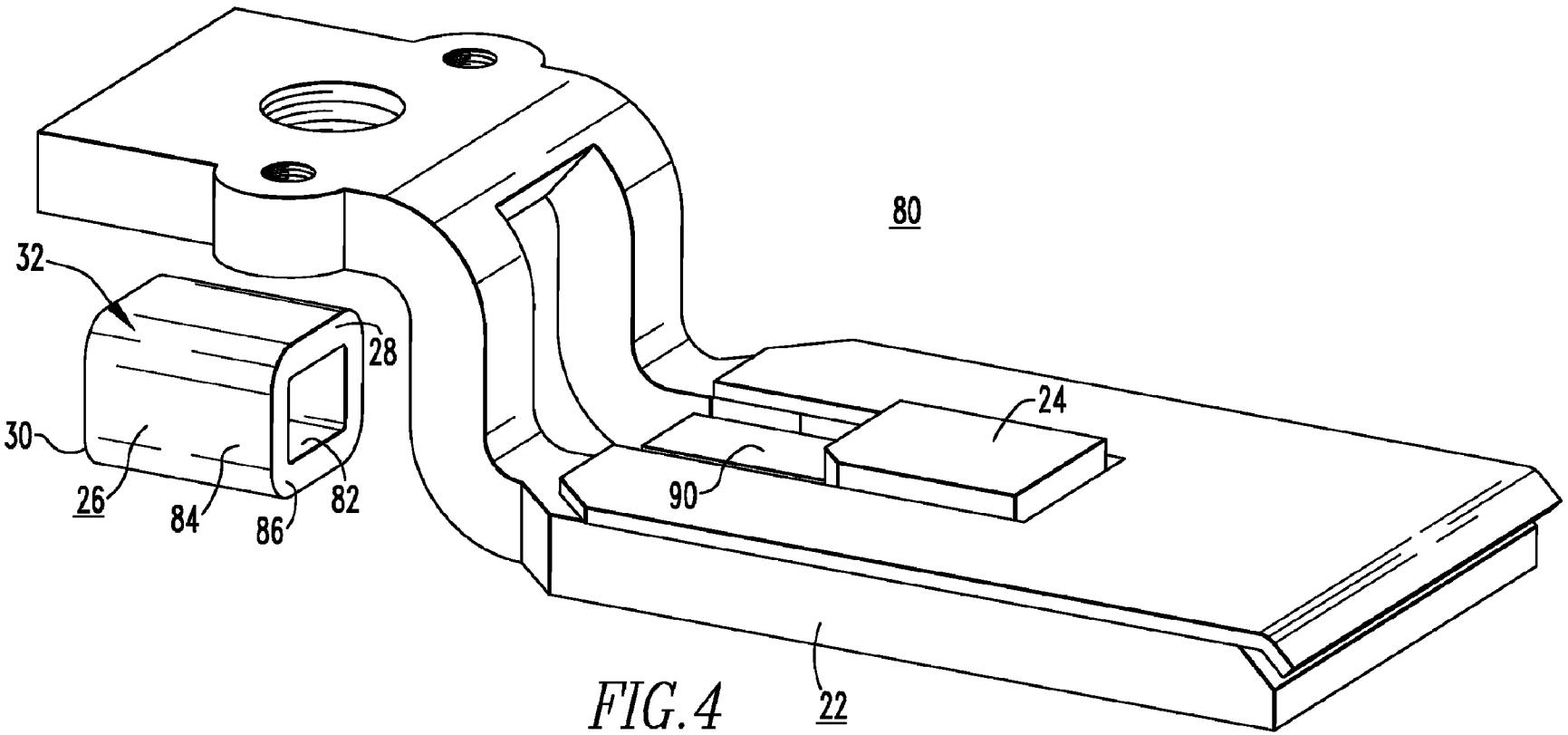
FIG. 4 is a partially exploded isometric view of the arc runner, stationary contact and line terminal conductor of FIG. 2.
Figure 5:
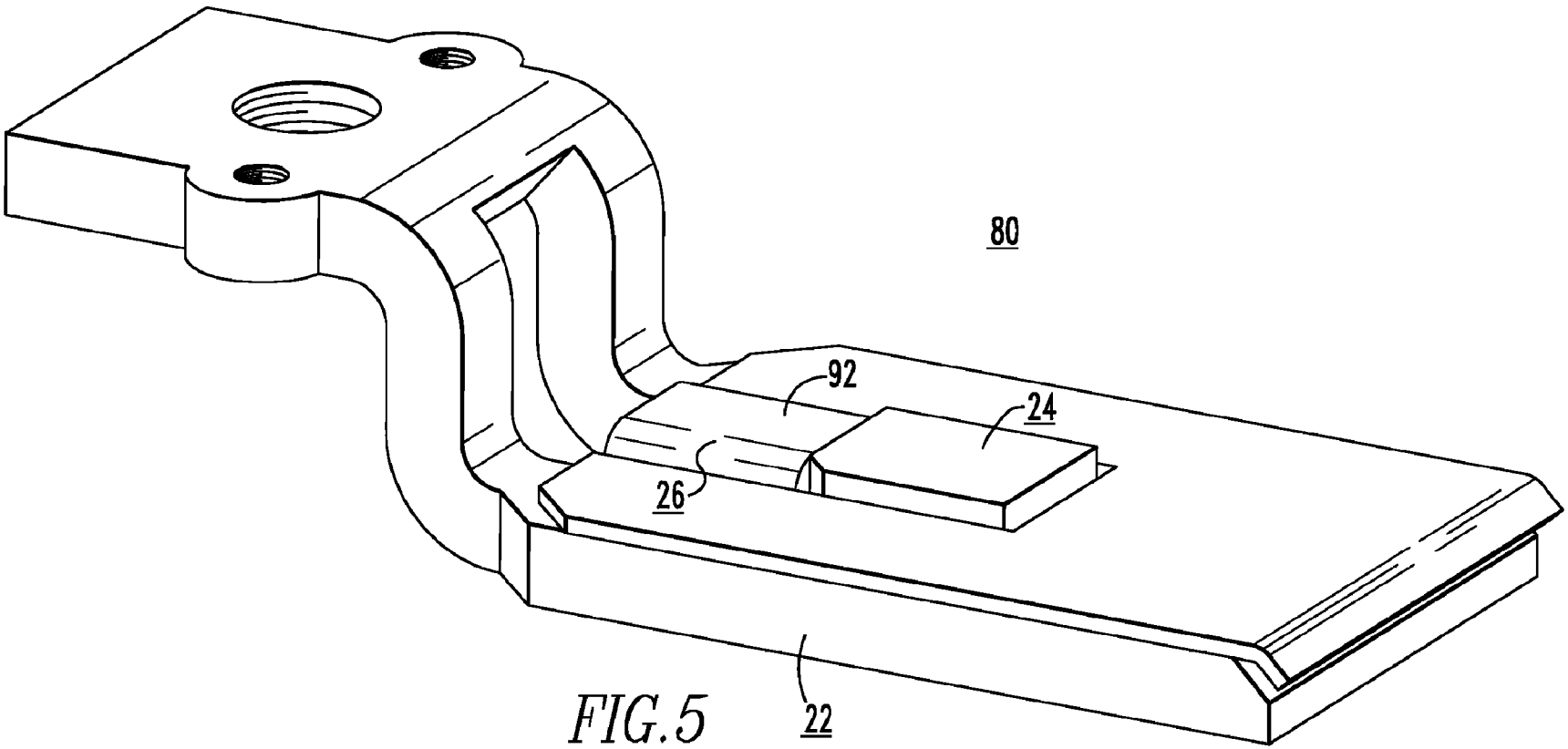
FIGS. 5 and 6 are isometric views of the arc runner, stationary contact and line terminal conductor of FIG. 2, which form an arc runner assembly.
Figure 6:
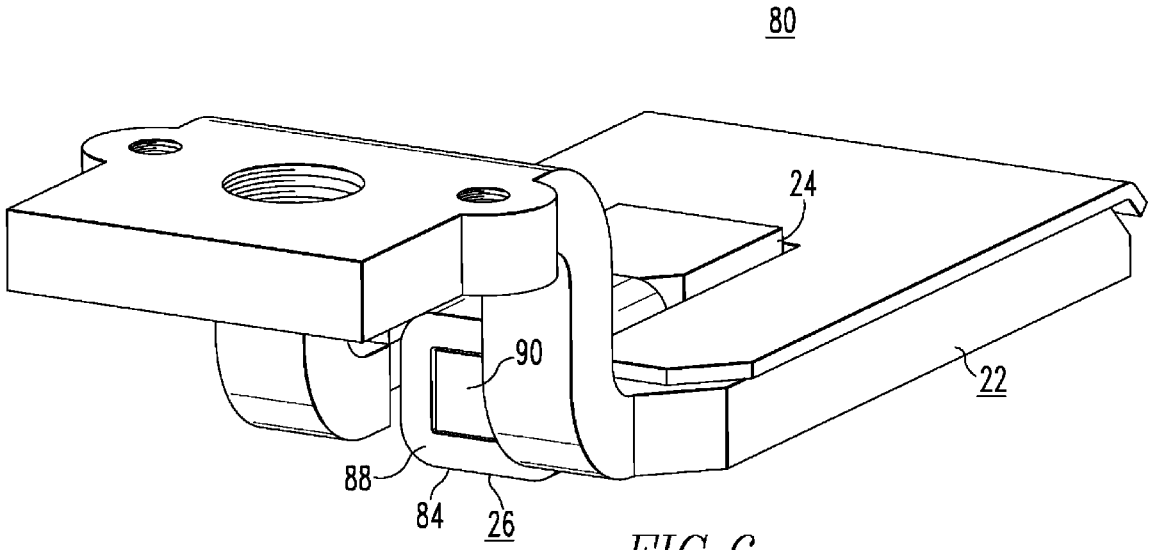

Referring to FIGS. 4-6, the arc runner 26 and line terminal conductor 22 which form an arc runner assembly 80 are shown. As best shown in FIGS. 4 and 6, arc runner 26 is preferably formed from steel and includes an internal surface 82 and an external surface 84 bounded at a first face 86 and an opposite second face 88 (FIG. 6). Although the example arc runner 26 shown in FIGS. 4-6 is a conduit of generally rectangular tubular shape, it is to be appreciated that other suitable formations may also be employed without departing from the scope of the disclosed concept (e.g., without limitation, tubular members of other shapes; non-tubular members of similar form), however, conduit formations are preferred in order to provide error-proof assembly. The internal surface 82 of arc runner 26 is sized to be installed on, and generally surround, a protruding portion 90 of the line terminal conductor 22. Preferably the internal surface 82 is sized such that arc runner 26 can be slid onto protruding portion 90 by hand with very little, if any, resistance and without the need for any type of mechanical assistance.

As shown in FIG. 5, when arc runner 26 is installed on the protruding portion 90 (FIG. 4), a portion of the first face 86

(FIG. 4) generally abuts fixed contact 24 such that a portion (not numbered) of the external surface 84 (FIG. 4) and the top surface (not numbered) of the fixed contact 24 generally form a substantially coextensive surface 92. It is to be readily appreciated that by providing such a coextensive surface 92, the arc runner 26 prevents an arc from stalling on the fixed contact 24.

Figure 7:
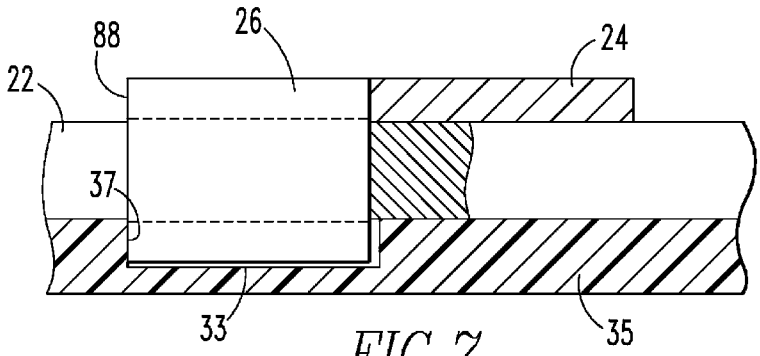
FIG. 7 is a partial cut away view of a portion of the circuit breaker of FIG. 3 showing details of internal structures.

Referring to FIGS. 2, 3 and 7, when the arc runner assembly 80 is disposed on base portion 35 of housing 34, a portion 30 of the arc runner 26 engages a recess 33 of base portion 35. Preferably, line terminal conductor of the arc runner assembly 80 is secured to the base portion 35 by suitable fastening mechanism(s), such as, without limitation, fastening screws. The engagement of the arc runner 26 and recess 33, particularly the interaction of a portion of second face 88 of arc runner 26 and sidewall 37 of recess 33 (FIG. 7), retains the arc runner 26 on protruding portion 90 (FIG. 4) without the need for mechanical fasteners or other retention mechanisms (e.g., press-fitting, welding).

In addition to eliminating the need for mechanical fasteners and/or other retention mechanisms, the arc runner assembly 80 also provides material cost reductions as complicated machining and/or forming are not needed as the arc runner 26 may be formed simply by cutting sections of premade conduit.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An arc runner assembly for an electrical switching apparatus including a housing, said arc runner assembly comprising:

a conductor;

a fixed contact electrically coupled to said conductor;

an arc runner disposed on said conductor adjacent said fixed contact, said arc runner including a first portion abutting said fixed contact and a second portion structured to engage a portion of said housing;

wherein said arc runner is structured to draw an arc from said fixed contact;

wherein said conductor comprises a protruding portion; and wherein said arc runner comprises an internal surface and an external surface, said internal surface forming a conduit and generally surrounding the protruding portion of said conductor; and wherein said conduit is of generally rectangular shape.

2. The arc runner assembly of claim 1 wherein said external surface is of generally rectangular shape.

3. An electrical switching apparatus comprising:

a housing;

a conductor;

a fixed contact electrically coupled to said conductor;

an arc runner disposed on said conductor adjacent said fixed contact, said arc runner including a first portion abutting said fixed contact and a second portion engaging a portion of said housing;

a movable contact;

an operating mechanism cooperating with said movable contact for opening and closing said fixed and movable contacts;

an arc chute adjacent said arc runner;

wherein said arc runner is structured to draw an arc from said fixed contact, said arc being formed from said opening of said fixed and movable contacts;

wherein said conductor comprises a protruding portion;

wherein said arc runner comprises an internal and an external surface, said internal surface forming a conduit and generally surrounding the protruding portion of said conductor; and wherein said conduit is of generally rectangular shape.

4. The electrical switching apparatus of claim 3 wherein said external surface is of generally rectangular shape.

* * * * *